US007106984B2

(12) United States Patent
Katsumi

(10) Patent No.: US 7,106,984 B2
(45) Date of Patent: Sep. 12, 2006

(54) IMAGE FORMING APPARATUS

(75) Inventor: Toru Katsumi, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 95 days.

(21) Appl. No.: 10/823,687

(22) Filed: Apr. 14, 2004

(65) Prior Publication Data

US 2004/0218941 A1 Nov. 4, 2004

(51) Int. Cl.
*G03G 15/20* (2006.01)

(52) U.S. Cl. ..... 399/66

(58) Field of Classification Search ..... 399/44, 399/49, 50, 51, 55, 66, 72
See application file for complete search history.

(56) References Cited

U.S. PATENT DOCUMENTS

| | | | | |
|---|---|---|---|---|
| 4,386,577 | A | 6/1983 | Hosono et al. | 118/657 |
| 4,387,664 | A | 6/1983 | Hosono et al. | 118/658 |
| 4,421,057 | A | 12/1983 | Hosono et al. | 118/657 |
| 4,458,627 | A | 7/1984 | Hosono et al. | 118/657 |
| 5,038,177 | A | 8/1991 | Parker et al. | 355/273 |
| 5,296,903 | A | 3/1994 | Suzuki et al. | 355/271 |
| RE34,724 | E | 9/1994 | Hosono et al. | 118/657 |
| 5,926,669 | A * | 7/1999 | Sugimoto et al. | 399/66 |
| 5,983,044 | A * | 11/1999 | Kodama et al. | 399/49 |
| 6,223,004 | B1 | 4/2001 | Kodama | 399/44 |
| 6,363,228 | B1 | 3/2002 | Ream | 399/66 |
| 2002/0057933 | A1 | 5/2002 | Ebihara et al. | 399/303 |

FOREIGN PATENT DOCUMENTS

| | | |
|---|---|---|
| EP | 0 831 381 A2 | 3/1998 |
| JP | 54-43038 | 4/1979 |
| JP | 8-202171 | 8/1996 |
| JP | 2000-89530 | 3/2000 |
| JP | 2001-125338 | 5/2001 |

OTHER PUBLICATIONS

Patent Abstracts of Japan, Publication No. 8-202171, Aug. 9, 1996.
Patent Abstracts of Japan, Publication No. 2000-89530, Mar. 31, 2000.

* cited by examiner

*Primary Examiner*—Hoang Ngo
(74) *Attorney, Agent, or Firm*—Fitzpatrick, Cella, Harper & Scinto

(57) ABSTRACT

To provide an image forming apparatus including: an image forming unit for forming an image on an image bearing member; a transfer unit for electrostatically transferring the image on the image bearing member onto a transfer medium in a transfer portion, the transfer unit including a transfer member that is capable of nipping the transfer medium in a space with the image bearing member and a voltage application unit for applying a voltage to the transfer member; a control unit for performing a detection operation that detects a voltage-current characteristic concerning the transfer member at the time of a non-transfer operation of the transfer unit and determining a transfer voltage at the time of a transfer operation based on a detection result of the detection operation; and a potential changing unit that is capable of changing a potential of a surface of the image bearing member on which the image has been formed by the image forming unit and which does not yet reach the transfer portion, in which the control unit performs the detection operation at the time when the image bearing member surface processed by the potential changing unit passes through the transfer portion.

6 Claims, 9 Drawing Sheets

IMAGE FORMING APPARATUS

BACKGROUND OF THE INVENTION

1. Field of the Invention

The present invention relates to a method of determining an optimum transfer bias for transferring a developed image formed on an image bearing member onto a transfer medium, such as an intermediate transfer member or a transferring material, in an image forming apparatus such as a copying machine or a printer adopting an electrophotographic system or an electrostatic recording system.

2. Related Background Art

As a conventional example of an image forming apparatus adopting the electrophotographic system, a full-color image forming apparatus using an intermediate transfer system is known in which electrostatic latent images are formed on one or multiple photosensitive drums that each serve as an image bearing member, developed images (toner images) in respective colors that are yellow, magenta, cyan, and black are formed by sequentially developing the latent images using toners in the colors that each serve as a developer, these toner images are transferred (primarily transferred) onto a drum-shaped or belt-shaped intermediate transfer member serving as a transfer medium so that the toner images are superimposed on each other, and the toner images on the intermediate transfer member are transferred (secondarily transferred) onto a transferring material by one operation, thereby obtaining a recorded image. As another conventional example, a monochrome image forming apparatus is known in which only a toner image in black is formed on a photosensitive drum and the toner image is directly transferred onto a transferring material.

In such an apparatus, in a transfer process where primary transfer from a photosensitive drum serving as an image bearing member is performed, a conductive transfer roller or the like is used as transfer means. The transfer roller is used while being abutted against the photosensitive drum and an intermediate transfer member and is given electric charges necessary to transfer a toner image not through discharging but through charge injection. Consequently, it is advantageous because the amount of ozone generated is small.

By the way, it is known that the resistance of the transfer roller tends to fluctuate due to the temperature/humidity or energization in the apparatus. In particular, when an ion conductive transfer roller made of a material where an ion conductive agent or a surface-active agent is dispersed is used, the resistance fluctuations described above easily occur.

On the other hand, if an electronic conductive transfer roller where a conductive filler, such as carbon or a metallic oxide, is dispersed as a conductive agent is used, the resistance fluctuations due to the temperature/humidity or energization are suppressed. However, when the surface of the transfer roller becomes soiled by toner as a result of long-term use or the thickness of a photosensitive surface layer opposing the transfer roller is reduced due to wear, the overall resistance of construction elements including the transfer roller and the photosensitive drum changes.

In either case, the resistance fluctuations occur, so that even if a constant voltage is applied to the transfer roller as a transfer bias, a current flowing to the transfer roller fluctuates, which results in a problem that optimum toner image transfer becomes impossible.

In order to prevent the occurrence of a transfer failure ascribable to the resistance fluctuations of the transfer roller, a method described in Japanese Patent Application Laid-Open No. 2001-125338 is used, for instance. With this method, a relation between a voltage applied to the transfer roller and a current flowing to a transfer part is measured as a pre-processing process and a transfer bias applied to the transfer roller is optimally controlled in accordance with a result of the measurement.

With this control method, a constant voltage obtained through constant voltage control is applied to the photosensitive drum from the transfer roller during pre-rotation before image formation (image creation), a current value at that time is detected, an optimum voltage V0 necessary to obtain an optimum current I0 is calculated from a relation between the voltage applied to the transfer roller and the current flowing to the transfer part, and the voltage V0 is applied as a transfer bias at the time of transfer during the image formation. As a result of these operations, even if the resistance of the transfer roller fluctuates, it becomes possible to cause the optimum current to flow to the transfer part at all times.

It should be noted here that in this specification, the term "pre-rotation" refers to a time slot, during which each image forming means operates, in a time period from the transmission of a print signal from the outside to the image forming apparatus to the arrival of the first sheet of the transferring material to a transfer position (transfer portion) of a developer image in an image forming process.

Meanwhile, as a method of developing an electrostatic latent image formed on the photosensitive drum using toner, various developing methods are known. In particular, with a magnetic brush developing method using a two-component developer containing toner and a magnetic carrier, a uniform image is obtained with relative stability, so that this method is applied to a color developing system. With this magnetic brush developing method, however, when the surface of the carrier becomes contaminated with a toner component, it becomes impossible to sufficiently charge the toner and the developing efficiency of the toner is lowered. Consequently, this developing method has a shortcoming unique to a two-component developer that periodical replacement of the carrier is required.

In order to overcome this shortcoming, a developing method that uses a one-component developer composed of a magnetic toner and not containing a carrier is used. With this developing method, the carrier degradation problem does not occur, so that developer replacement becomes unnecessary. Consequently, this method is particularly suited for development in black that is frequently performed. This one-component developing method uses no carrier as described above, so that in order to give electric charges to the toner, a method described in Japanese Patent Application Laid-Open No. S54-43038 is used, for instance. With this method, electric charges are given to the toner through triboelectrification between the toner and a developer bearing member that is provided for a developing device for performing a developing operation and feeds the toner to the photosensitive drum.

In addition, there is a case where a sufficient amount of electric charges is not given to the toner only through the triboelectrification between the toner and the developer bearing member and therefore sufficient transfer efficiency is not obtained. In view of this problem, a method is adopted with which charge before transfer is performed using a corona charger before a transfer process. As a result of the charge before transfer, electric charges having the same polarity as the toner are given to a toner image on the photosensitive drum after development and the toner electric charge amount is adjusted so that the transfer efficiency increases.

When the transfer bias control described above is performed in an image forming apparatus that performs such charge before transfer, however, there occurs a problem described below.

When the charge before transfer is performed, the toner electric charge amount increases and the potential of the photosensitive drum also changes. The photosensitive drum surface potential displaces to a polarity side that is the same as the toner charge polarity and the transfer bias has a polarity opposite to the polarity of the toner. Therefore, when the charge before transfer is performed, a potential difference between the photosensitive drum and the transfer roller in the transfer part increases. The transfer bias control before the image creation is performed under a state of charge OFF before transfer, while the image creation is performed under a state of charge ON before transfer.

Therefore, the potential difference described above during the image creation is larger than that before the image creation. Consequently, if a voltage determined through the transfer bias control is applied at the time of transfer, an excess current flows and a so-called "re-transfer phenomenon" occurs in which toner once transferred onto a transfer medium, such as an intermediate transfer member or a transferring material, is re-transferred back to the photosensitive drum, which leads to a problem that an image density is lowered.

SUMMARY OF THE INVENTION

The present invention has been made in order to solve the problems described above, and therefore has an object to provide an image forming apparatus capable of performing transfer from an image bearing member under an optimum state.

To attain the above-mentioned object of the invention, there is provided an image forming apparatus including:

image forming means for forming an image on an image bearing member;

transfer means for electrostatically transferring the image on the image bearing member onto a transfer medium in a transfer portion, the transfer means including a transfer member that is capable of nipping the transfer medium in a space with the image bearing member and voltage application means for applying a voltage to the transfer member;

control means for performing a detection operation that detects a voltage-current characteristic concerning the transfer member at the time of a non-transfer operation of the transfer means and determining a transfer voltage at the time of a transfer operation based on a detection result of the detection operation; and potential changing means that is capable of changing a potential of a surface of the image bearing member on which the image has been formed by the image forming means and which does not yet reach the transfer portion, wherein the control means performs the detection operation at the time when the image bearing member surface processed by the potential changing means passes through the transfer portion.

DESCRIPTION OF THE PREFERRED EMBODIMENTS

The image forming apparatus according to the present invention will now be described in more detail with reference to the accompanying drawings.

First Embodiment

Figure 1:
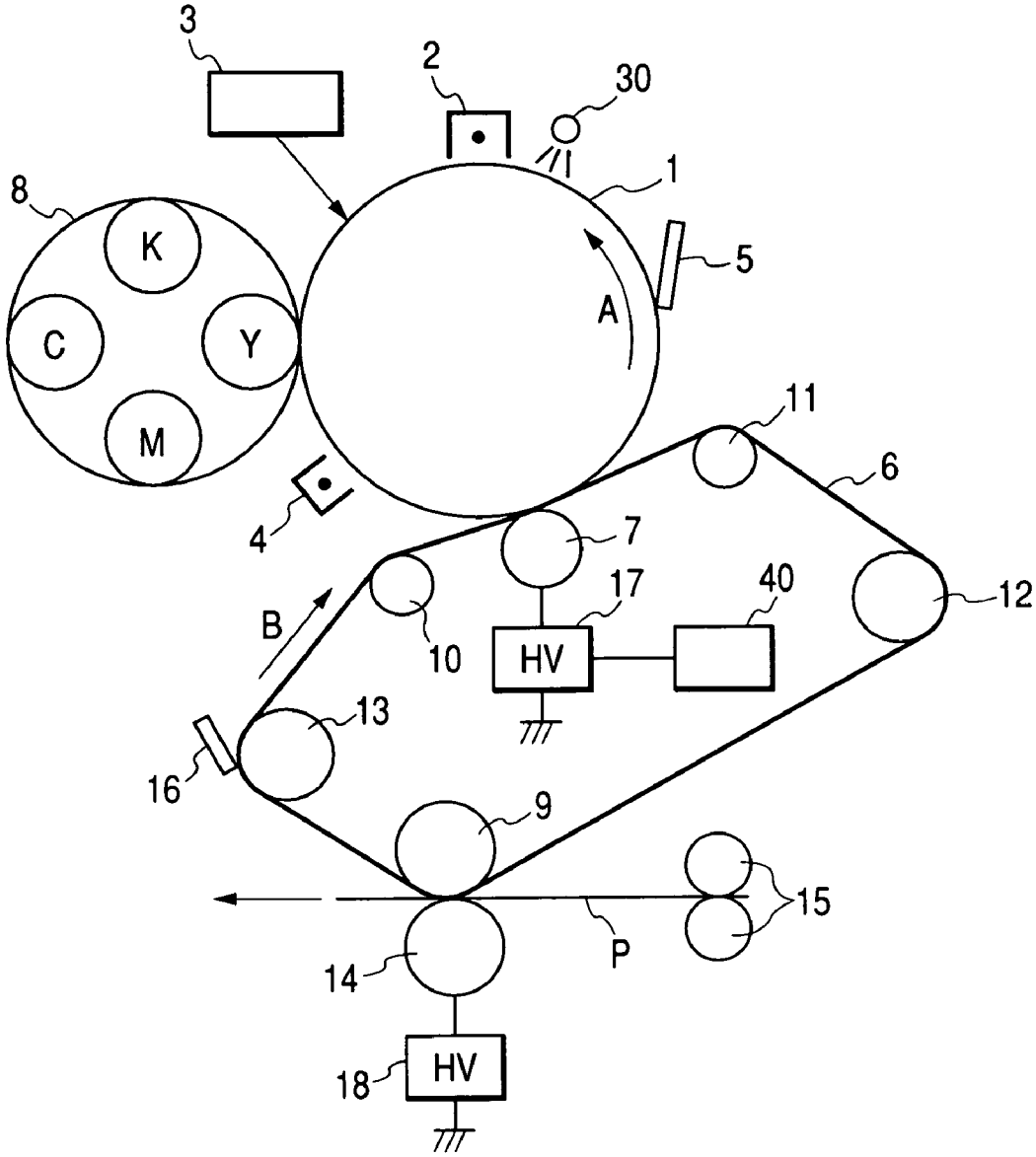
FIG. 1 is a schematic construction diagram showing a first embodiment and a second embodiment of the image forming apparatus according to the present invention.

FIG. 1 shows a schematic construction of an example of an image forming apparatus to which the present invention is applied. In this embodiment, an example will be described in which the present invention is applied to a color image forming apparatus adopting the electrophotographic system and the intermediate transfer system where developed images (toner images) in multiple colors are formed on a photosensitive drum 1 serving as an image bearing member, the images are primarily transferred onto an intermediate transfer belt 6 that is an intermediate transfer member serving as a transfer medium so that these images are superimposed on each other, and the superimposed toner images in the multiple colors are transferred onto a transferring material P in a secondary transfer portion by one operation.

First, the overall construction of the image forming apparatus will be described. In FIG. 1, the photosensitive drum 1 is an image bearing member and is rotated in a direction of arrow A. Electrostatic latent images corresponding to image information are formed on the photosensitive drum 1 by a charging apparatus 2 provided around the photosensitive drum 1 and an exposing apparatus 3 that performs exposure based on the image information. Also, a developing device unit 8 including developing devices containing toners in respective colors that are yellow (Y), magenta (M), cyan (C), and black (K) is disposed around the photosensitive drum 1 and the electrostatic latent images formed on the photosensitive drum 1 are each developed with a corresponding one of the developing devices described above, thereby forming toner images.

In this embodiment, the photosensitive drum 1 is produced using an amorphous silicon having a positive charge property and development is performed using a normal developing system. Consequently, the toners used here are each toner having a negative charge property. Among the developing devices, the developing devices for Y, M, and C each use a two-component developer and the developing device for K uses a magnetic one-component developer.

On the downstream side of the developing unit 8 in the rotation direction of the photosensitive drum 1, charge means before transfer (charger before transfer) 4 that is a corona charger is disposed so as to face the photosensitive drum 1 and is connected to a not-shown DC or AC+DC high-voltage power supply. With the charger before transfer 4, charge before transfer is performed on the toner image formed on the photosensitive drum 1 before the-image reaches a primary transfer portion. With this construction, a sufficient transfer efficiency is given to the toner image in black (pre-charge developed image) for which the one-component developing system is adopted.

Also, the intermediate transfer belt 6 disposed so as to be abutted against the surface of the photosensitive drum 1 is looped around multiple looping rollers 9 to 13 and is rotated in a direction of arrow B. In this embodiment, the looping rollers 10 and 11 are arranged in proximity to the primary transfer position and forms a nip for primary transfer by setting a flat surface of the intermediate transfer belt 6 so as to be abutted against the photosensitive drum 1. Also, the looping roller 12 is a tension roller for maintaining constant tension of the intermediate transfer belt 6 and is energized by a not-shown pressurizing spring. Further, the looping roller 13 is a drive roller 13 for rotating the intermediate transfer belt 6, and the looping roller 9 is a secondary transfer opposing roller (backup roller) 9 that pressure-contacts a secondary transfer roller 14 and forms the secondary transfer portion.

As the intermediate transfer belt 6, a belt is used which is made of a material where an appropriate amount of carbon black is added to a resin such as polyimide, polycarbonate, polyethylene terephthalate, or polyvinylidene fluoride, with its volume resistivity being set at $1\times10^{8}$ to $1\times10^{13}$ Ω·cm and its thickness being set at 70 to 100 μm.

In addition, at the primary transfer position of the intermediate transfer belt 6 opposing the photosensitive drum 1, a primary transfer roller 7 serving as transfer means is disposed on the inner surface side of the intermediate transfer belt 6. A transfer bias having a polarity opposite to the charge polarity of the toners is applied to the primary transfer roller 7 using a high-voltage power supply (transfer bias application means) 17, thereby primarily transferring the toner images on the photosensitive drum 1 onto the intermediate transfer belt 6.

Also, a drum cleaner 5 for removing a residual toner on the photosensitive drum 1 after the primary transfer is provided so as to oppose the photosensitive drum 1. After the cleaning of the photosensitive drum 1 by the drum cleaner 5, residual electric charges of the photosensitive drum 1 are attenuated by a charge eliminating lamp 30, thereby making a preparation for the next image creation.

Also, the secondary transfer roller 14 arranged so as to pressure-contact a toner image bearing surface side of the intermediate transfer belt 6 and the backup roller 9 grounded, disposed on the inner surface side of the intermediate transfer belt 6, and functioning as a counter electrode of the secondary transfer roller 14 are provided at the secondary transfer position of the intermediate transfer belt 6 facing the transport path of the transferring material P. A secondary transfer bias having a polarity opposite to the toner charge polarity is applied to the secondary transfer roller 14 by a high-voltage power-supply 18. Further, a belt cleaner 16 for removing a residual toner on the intermediate transfer belt 6 after the secondary transfer is provided on a downstream side of the secondary transfer position. Note that the secondary transfer roller 14 and the belt cleaner 16 are disposed so as to be movable with respect to the intermediate transfer belt 6. In more detail, at the time of formation of a color image using multiple colors, the secondary transfer roller 14 and the belt cleaner 16 are spaced apart from the intermediate transfer belt 6 until a toner image in a color preceding a final color passes by the secondary transfer roller 14 and the belt cleaner 16. Then, before a toner image in the final color reaches the secondary transfer position, the secondary transfer roller 14 and the belt cleaner 16 are moved so as to be abutted against the intermediate transfer belt 6.

The transferring material P is nipped between registration rollers 15 and is temporarily stopped for registration. Following this, the transferring material P is sent to the secondary transfer position at a predetermined timing. After the secondary transfer, the transferring material P is further sent to a fixing apparatus (not shown) by a transport member (not shown) and the toner images on the transferring material P are fused and fixed.

Next, an image creation process of this apparatus will be described. First, an electrostatic latent image is written onto the photosensitive drum 1 and is developed by one of the developing devices corresponding to this electrostatic latent image. In more detail, if the electrostatic latent image written onto the photosensitive drum 1 corresponds to image information in yellow, for instance, this electrostatic latent image is developed using the developing device Y containing the toner in yellow, thereby forming a toner image in yellow on the photosensitive drum 1.

Then, the toner image formed on the photosensitive drum 1 is transferred from the photosensitive drum 1 to the surface of the intermediate transfer belt 6 at the primary transfer position at which the photosensitive drum 1 and the intermediate transfer belt 6 contact each other.

When doing so, in the case of formation of a monochrome image, the toner image primarily transferred onto the intermediate transfer belt 6 is secondarily transferred to the transferring material P without delay. In contrast to this, in the case of formation of a color image in which toner images in multiple colors are superimposed on each other, the process for forming a toner image on the photosensitive drum 1 and primarily transferring the toner image is repeated by a number of times corresponding to the number of the colors. When a full-color image is formed by superimposing toner images in four colors, for instance, each time the photosensitive drum 1 makes one rotation, one of toner images in yellow, magenta, cyan, and black is formed on the photosensitive drum 1, with the toner images in the respective colors being primarily transferred onto the intermediate transfer belt 6 in succession. When doing so, before the primary transfer, the toner image on the photosensitive drum 1 is charged by the charger before transfer 4 as necessary, thereby giving electric charges to the toner image.

In this embodiment, as described above, the magnetic one-component developer is used for black and the charge amount of the black toner is insufficient, so that the charge before transfer is performed only for a toner image in black.

Meanwhile, the intermediate transfer belt 6 is rotated in the same cycles as the photosensitive drum 1 while bearing each toner image primarily transferred thereonto, and one of toner images in yellow, magenta, cyan, and black is transferred onto the intermediate transfer belt 6 each time the intermediate transfer belt 6 makes one rotation, with the toner images in the respective colors being superimposed on each other.

The toner images primarily transferred onto the intermediate transfer belt 6 in this manner are transported to the secondary transfer position with the rotation of the intermediate transfer belt 6. On the other hand, the transfer material P is supplied to the secondary transfer position by the registration rollers 15 at a predetermined timing and is nipped between the backup roller 9 and the secondary transfer roller 14. When doing so, a secondary transfer bias is applied to the secondary transfer roller 14 and the toner images borne by the intermediate transfer belt 6 are electrostatically transferred to the transferring material P by the action of a transfer electric field formed between the secondary transfer roller 14 and the backup roller 9.

As the primary transfer roller 7 or the secondary transfer roller 14, a roller is used whose resistance value has been adjusted to around $1\times10^{6}$ to $1\times10^{10}$ (Ω). These transfer rollers are each produced by providing a conductive elastic layer around the outer peripheral surface of a metal core made of a metal. In order to give conductivity to the rollers, two methods described below are mainly used. With one of the methods, an electronic conductive transfer roller is produced by dispersing a conductive filler, such as carbon or a metallic oxide, in an EPDM or urethane sponge or the like, with its resistance value being adjusted by changing the addition amount of the conductive filler. With the other of the methods, an ion conductive transfer roller made of an ion conductive material, such as an NBR rubber or sponge, an urethane rubber or sponge, an epichlorohydrin rubber or sponge, or the like, is produced by giving conductivity to the material itself or dispersing a surface-active agent in the material.

Figure 2:
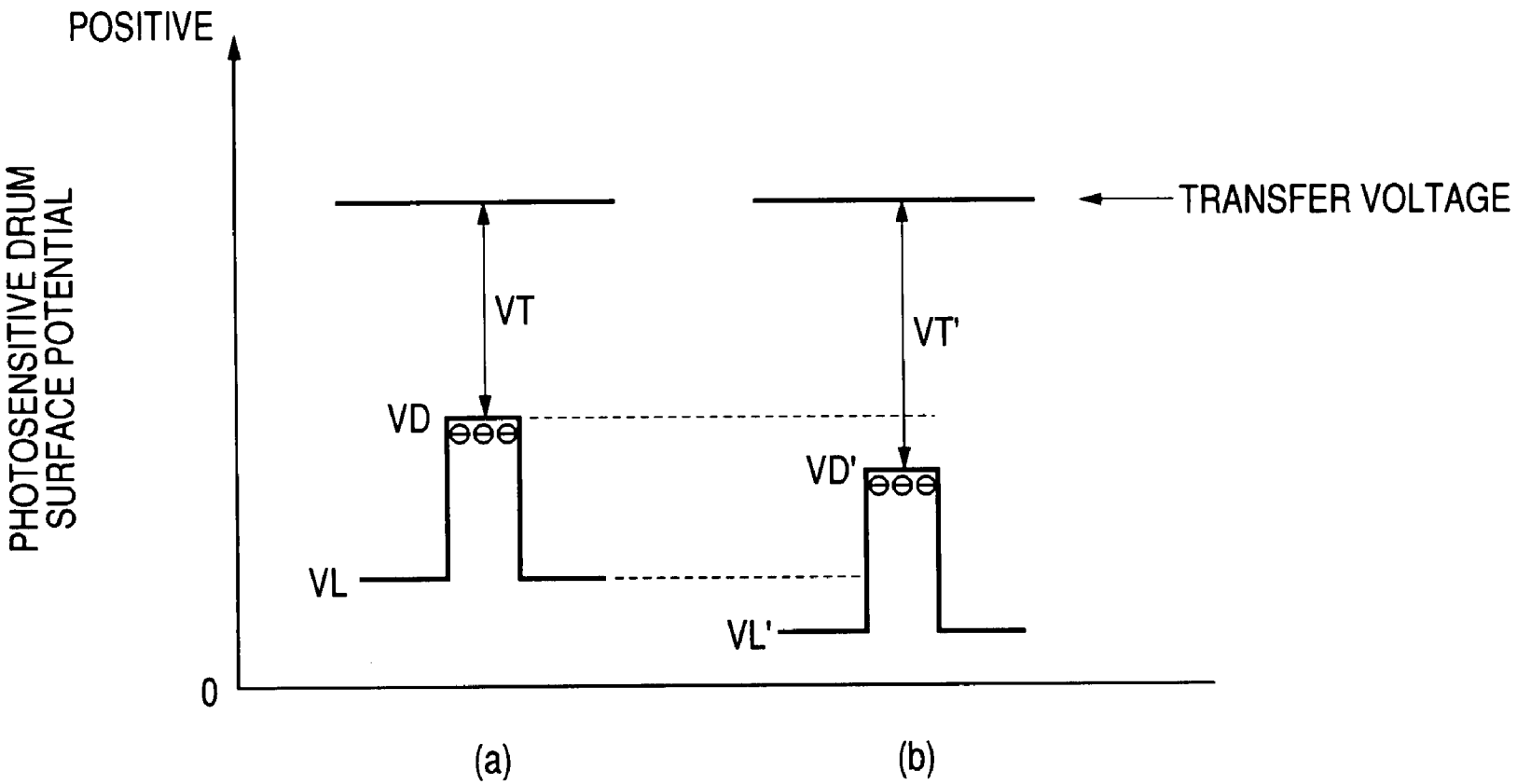
FIG. 2 is an explanatory diagram showing how an image bearing member surface potential changes and a relation thereof with a transfer bias in the first embodiment.

Next, how the surface potential of the photosensitive drum 1 changes as a result of the charge before transfer by the charger before transfer 4 will be described with reference to FIG. 2. The charge before transfer is performed at the time of creation of a pre-charge developed image that requires the charge before transfer, that is, a black toner image in this embodiment. In FIG. 2, a potential before the charge before transfer is shown on the left side (a), while a potential after the charge before transfer is shown on the right side (b).

On the left side (a) of this drawing, a potential VD of a portion subjected to charging and a potential VL of a portion subjected to exposure after the charging are shown, with each of these potentials having a positive polarity. The unexposed portion having the potential VD is developed using toner (having a negative polarity) as an image portion of a toner image. Electric charges having the same polarity as the toner, that is, the negative polarity are given to the toner image and the photosensitive drum 1 through the charge before transfer, so that the potentials VD and VL are respectively lowered to potentials VD' and VL' shown on the right side (b).

When a constant transfer bias having a positive polarity is applied, a potential difference VT (corresponding to a transfer electric field) occurs between the potential VD of the toner image portion and the transfer bias that is a potential higher than the potential VD. As a result of the charge before transfer, however, the potential VD becomes VD' as shown in FIG. 2, so that the potential difference VT is increased to VT', which results in a situation where a current flows excessively.

Figure 3:
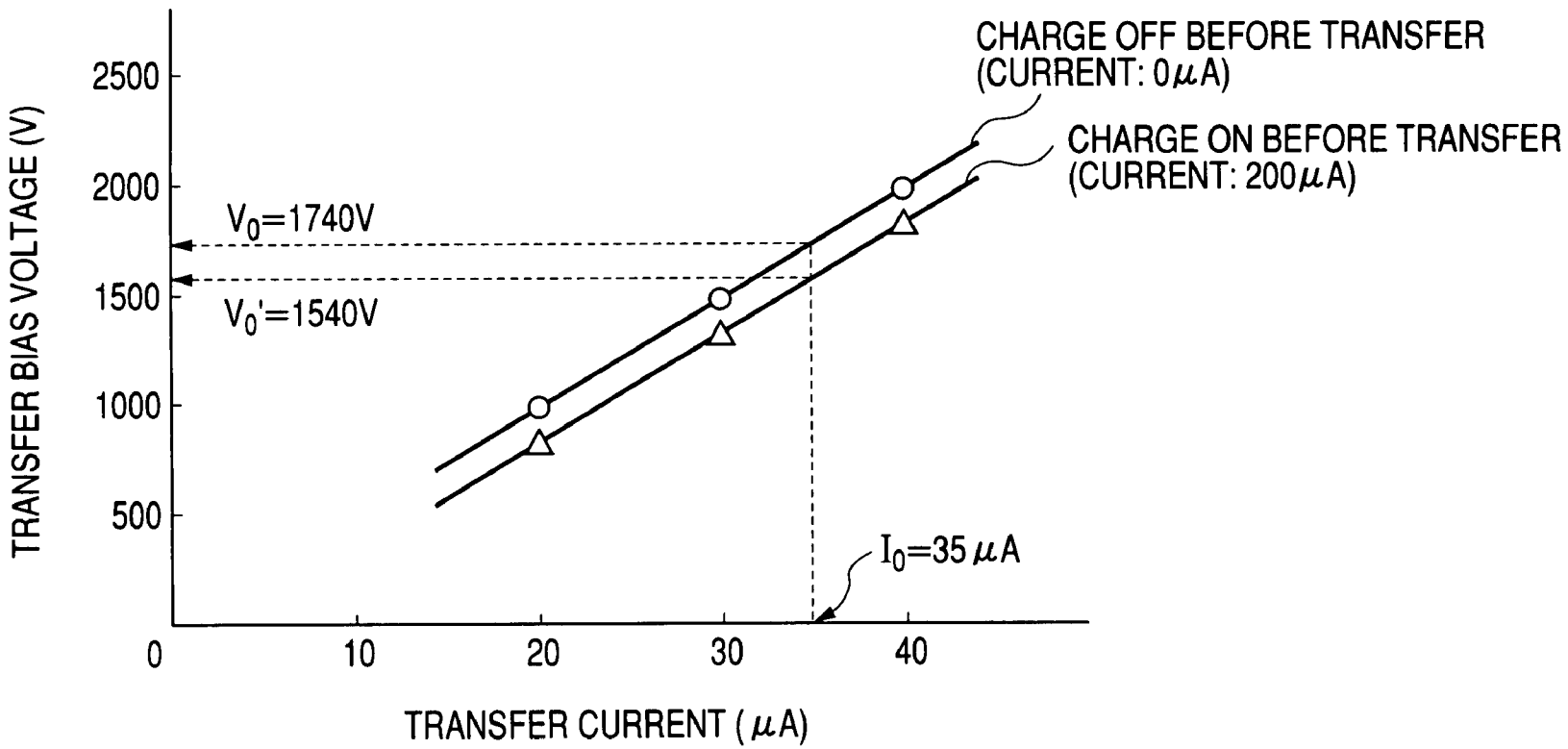
FIG. 3 is a graph showing a relation between a voltage and a current applied to transfer means in the first embodiment.

In view of this problem, a transfer bias control method shown in FIG. 3 where consideration is given to the result described above is used in this embodiment. As a pre-processing process, during pre-rotation immediately before an image creation process, the VL potential (corresponding to a white background (non-image portion) potential) is formed on the photosensitive drum 1 by operating the charging apparatus 2 and the exposing apparatus 3 described with reference to FIG. 1. Under this state, primary transfer currents at 20 μA, 30 μA, and 40 μA are each applied to the primary transfer roller 7 as a constant current and voltage values at that time are detected.

In FIG. 3, a current-voltage relation in the case of charge OFF before transfer during pre-rotation (current of the charge before transfer is set at 0μA) and a current-voltage relation in the case of charge ON before transfer using a current to be applied in an image creation process (current of the charge before transfer is set at 200μA) are both shown. In this embodiment, a DC charge before transfer is performed. As can be seen from this drawing, in the case of charge ON before transfer, a voltage required to cause a predetermined current to flow is reduced due to the reason described above.

Therefore, it becomes possible to apply an appropriate transfer bias to a black toner image for which the charge before transfer is performed by, for instance, obtaining in advance an optimum current for transferring the black toner image formed in the VD potion through an experiment, obtaining a current I0 (=35 μA) flowing when the voltage applied at that time is applied to the VL portion (white background potential portion), and calculating a transfer bias necessary to obtain I0 through linear interpolation of the current-voltage relation detected above.

That is, with a conventional technique, the voltage detection is performed under a state of charge OFF before transfer, so that the transfer bias is determined to be at V0 (=1740 V) as shown in FIG. 3. However, image creation is performed under a state of charge ON before transfer, so that when V0 is applied during the image creation, a current exceeding I0 flows to the white background portion (non-image portion). In a like manner, an excess current flows to the toner image portion and therefore re-transfer occurs.

In contrast to this, in this embodiment, the voltage detection in the constant current control described above is performed under a state of charge ON before transfer, so that a deviation between a potential during the pre-rotation and a potential during the image creation is eliminated and it becomes possible to obtain an optimum transfer bias V0' (=1540 V).

When V0' obtained in this manner is applied during the image creation, the current I0 flows to the white background portion and an optimum current flows to the toner image portion. As a result, the re-transfer does not occur. Note that during transfer in the image creation process, the transfer bias is applied under a state where switching to constant voltage control is performed. When a toner image and a white background portion coexist on an image, if a transfer current is applied through the constant current control, a current flows to the white background portion having a low resistance in a concentrated manner and a current flowing to the toner image portion becomes insufficient, so that a transfer failure occurs. In order to prevent this problem, the constant voltage control is performed during the transfer.

It should be noted here that in the above description, the transfer bias for black is obtained by performing the current and voltage linear interpolation while applying three constant currents, although the present invention is not limited to this. For instance, the black transfer bias may be determined by performing the voltage detection while applying only one target current I0 (=35 μA).

Also, as described above, the charge before transfer is performed during black image creation, so that the charge before transfer is performed also at the time of the transfer bias voltage detection in the case of the black image. However, the charge before transfer is not performed during image creation in other colors that are yellow, magenta, and cyan, so that the voltage detection is performed under a state of charge OFF before transfer in this case. That is, the transfer bias for each of the other colors is determined by obtaining the current-voltage relation under the state of charge OFF before transfer shown in FIG. 3. Depending on the materials of the toners in these colors, however, there is a case where charge amounts of the color toners also become insufficient and therefore it is impossible to obtain sufficient transfer efficiencies. In this case, the charge before transfer needs to be performed also for the color toners. Therefore, in order to determine transfer biases for the color toners, the voltage detection is performed through charge before transfer having corresponding power.

It should be noted here that in ordinary cases, as a predetermined bias applied to the charger before transfer 4 at the time of the transfer bias voltage detection in the pre-processing process, a bias is applied which is the same as a bias applied at the time of the charge before transfer in the image formation process.

Also, there is a case where at the time of primarily transfer of the toner image in each color, the amount of electric charges that need to be given to the primary transfer part differs depending on the color of the toner image. Therefore, it is required to give the electric charges by setting a proper transfer bias for each color. That is, it is required to cause a proper primary transfer current to flow for each color. Accordingly, from the detected current-voltage relation, a required transfer bias is determined for each color. The transfer control described above, such as the detection of the voltage-current characteristic and the determination of the transfer voltage, is performed by control means 40 shown in FIG. 1.

Also, in order to increase the detection accuracy of the transfer bias voltage detection in the pre-processing process, the same constant current is caused to flow at least while the primary transfer roller 7 makes one rotation, voltages at 8 to 12 points are detected while the primary transfer roller 7 makes one rotation, and an average thereof is calculated. This is because the transfer roller has resistance unevenness in a circumferential direction thereof and it is required to suppress variations in a result of the voltage detection resulting from the resistance unevenness.

Second Embodiment

Figure 4:
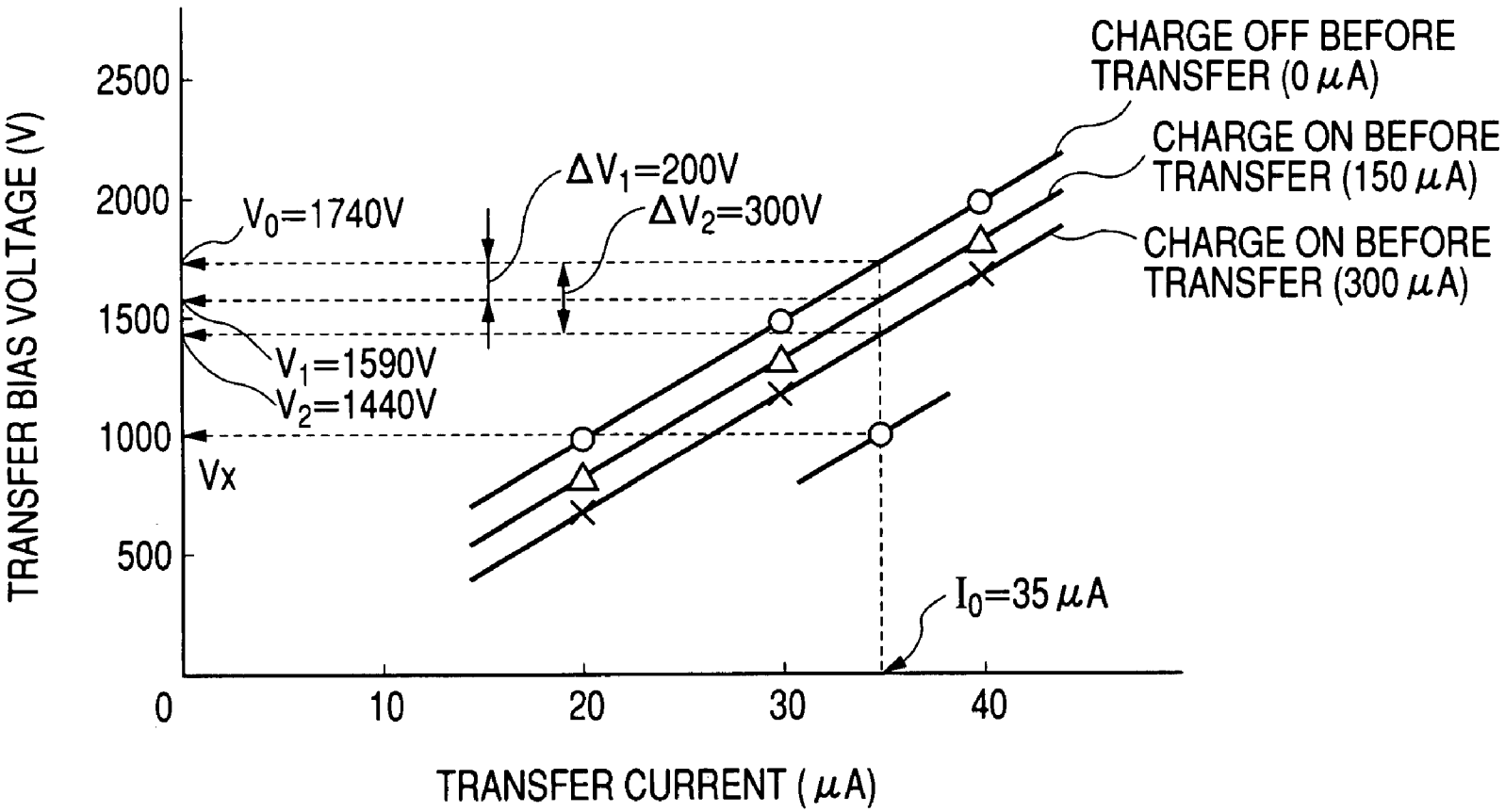
FIG. 4 is a graph showing the relation between the voltage and the current applied to the transfer means in the second embodiment.

Next, a second embodiment of the present invention will be described with reference to FIGS. 4 and 5.

In the first embodiment described above, the control for determining the transfer bias is performed during the pre-rotation. When the voltage detection is performed for multiple current points under a state of charge ON before transfer and a state of charge OFF before transfer during the pre-rotation, however, this leads to an inconvenient situation where a long time is consumed by the control, and a process time (print time) from the reception of a signal designating image creation start to the toner image transfer and fixation on the transferring material is elongated. Therefore, a technique of shortening the print time will be described in this embodiment.

In ordinary cases, immediately after the apparatus is powered ON, a several-minute warm-up is performed in order to heat the fixing apparatus. Then, a multiple rotation process, in which a heat roller provided for the fixing apparatus in order to realize uniform conduction of heat throughout the fixing apparatus is rotated, is performed. During this multiple rotation process, the photosensitive drum, the intermediate transfer belt, and the transfer roller are also rotated, thereby performing an operation check. When these operations are completed, the apparatus shifts to a standby status where it is possible to start image creation. Therefore, when the transfer bias control is performed during this multiple rotation, it becomes possible to simplify the control during the pre-rotation immediately before the image creation.

A transfer bias detection operation performed during the multiple rotation will be described below.

S1: First, the charging apparatus 2 and the exposing apparatus 3 are operated during the multiple rotation, thereby forming the VL potential (corresponding to a white background (non-image portion) potential) on the photosensitive drum 1.

S2: Next, under this state, as shown in FIG. 4, currents at 20 μA, 30 μA, and 40 μA are each applied to the primary transfer roller 7 as a constant current and voltage values at that time are detected. When doing so, the detection is performed by changing the output of the charge before transfer at three levels that are OFF (0 μA), 150 μA, and 300 μA. Then, from current-voltage relations detected in this manner, voltages V0, V1, and V2 necessary to obtain I0 (=35 μA) are calculated.

S3: Following this, a difference between V0 and V1 (ΔV1=V0−V1) and a difference between V0 and V2 (ΔV2=V0−V2) are calculated. That is, correction voltages for the cases where the charge before transfer is performed at 150 μA and 300 μA are calculated. In order to obtain I0 (=35 μA), a correction is made using these correction voltages with respect to V0 in the case of charge OFF before transfer.

Figure 5:
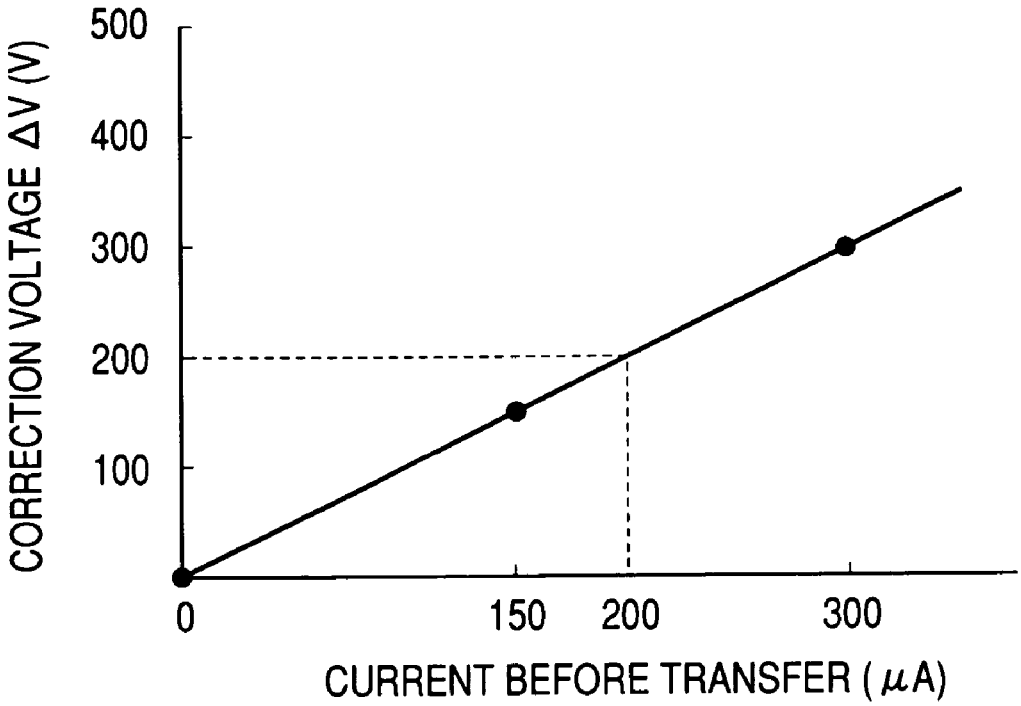
FIG. 5 is a graph showing a relation between a current before transfer and a transfer bias correction voltage in transfer bias control in the second embodiment.

FIG. 5 is a graph where the correction voltages ΔV obtained as a result of the operations described above are plotted with respect to a current before transfer. A correction voltage in the case of a current before transfer at 200 μA is calculated through linear interpolation of the plots and a result of "ΔVt=200 V" is obtained.

S4: Here, these control operations are performed during the multiple rotation and a result of the calculation is stored in a not-shown memory.

S5: Following this, when a signal designating start of image creation is inputted, the apparatus starts pre-rotation and causes the current I0 (=35 μA) to flow as a constant current under a state of charge OFF before transfer and a voltage Vx is detected. Here, a difference exists between the resistance of the primary transfer roller at the time of the multiple rotation and the resistance of the primary transfer roller at the time of the pre-rotation started at an arbitrary time due to an influence of the temperature/humidity and the like. Therefore, Vx becomes a value that is different from V0.

S6: Then, based on this Vx, a transfer bias Vt that should be applied during image creation is calculated from "Vt=Vx−ΔVt". It is found in advance through an experiment that potential changing due to the charge before transfer is almost constant regardless of the temperature/humidity. Therefore, from the equation described above, it is possible to set the transfer bias at an optimum value while giving consideration to the resistance fluctuations of the primary transfer roller and the influence of the charge before transfer.

According to a control system including the operations S1 to S6 described above, the contents of control performed during the pre-rotation are changed so that the number of levels of sampling and the number of current points in the case of charge ON before transfer are each reduced from three to one. As a result, it becomes possible to significantly shorten the print time and, at the same time, to set a transfer bias with which it is possible to apply an optimum transfer current.

Third Embodiment

Next, a third embodiment will be described. The control method described above is applicable not only to the color image forming apparatus but also to a monochrome image forming apparatus. An example of a monochrome image forming apparatus adopting the electrophotographic system is shown in FIG. 6.

Figure 6:
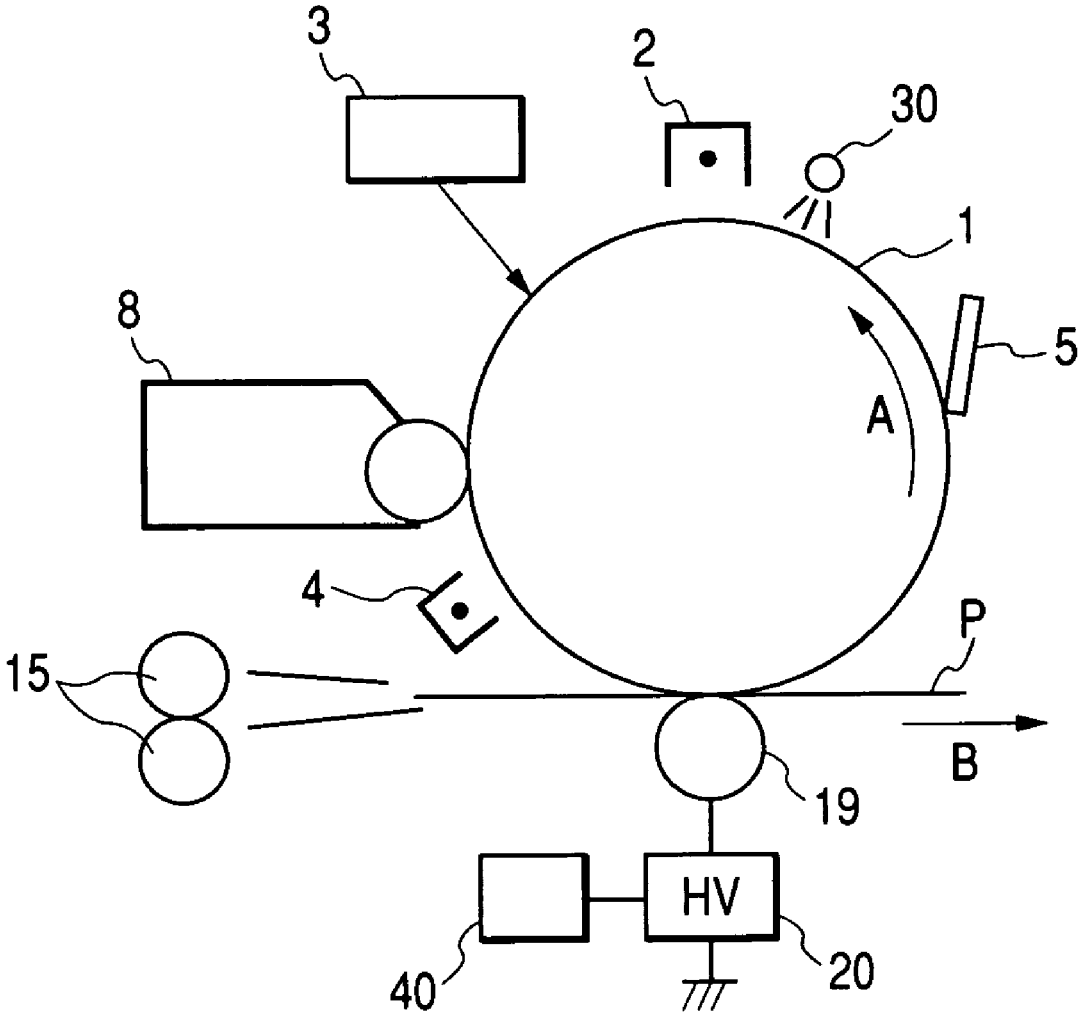
FIG. 6 is a schematic construction diagram showing a third embodiment of the image forming apparatus according to the present invention.

In FIG. 6, each portion having the same function as that of the color image forming apparatus shown in FIG. 1 is given the same reference numeral as in FIG. 1. A photosensitive drum 1 is rotationally driven at a predetermined peripheral velocity in a direction of arrow A. The peripheral surface of the photosensitive drum 1 is charged to a predetermined polarity and potential by a charging apparatus 2. An exposing apparatus 3 outputs laser light having been subjected to light emission control in accordance with image information that should be recorded, thereby forming an electrostatic latent image corresponding to the image information on the photosensitive drum 1.

A developing device 8 visualizes the electrostatic latent image on the photosensitive drum 1 using a black toner, thereby forming a toner image. As the toner, a magnetic one-component developer is used.

On the downstream side of the developing device 8, a charger before transfer 4 is disposed so as to face the photosensitive drum 1 and gives electric charges to the toner image.

In a not-shown sheet feeding cassette, a transferring material P serving as a transfer medium is contained. A not-shown sheet feeding roller is driven based on a sheet feeding start signal and the transferring material P in the sheet feeding cassette is fed one sheet at a time. The fed transferring material P is transported by registration rollers 15 in a direction of arrow B and is introduced into a transfer part that is a abutment nip portion between the photosensitive drum 1 and a transfer roller 19 serving as transfer means at a predetermined timing. That is, the transportation of the transferring material P is controlled by the registration rollers 15 so as to be synchronized with a timing at which the leading end portion of the toner image on the photosensitive drum 1 reaches the transfer part.

The transferring material P introduced into the transfer part is nipped at the transfer part and is further transported. When doing so, a transfer bias controlled to a predetermined bias is applied to the transfer roller 19 from a high-voltage power supply 20 as a constant voltage. This transfer bias control will be described later. As a result of the application of the transfer bias having a polarity opposite to that of the toner to the transfer roller 19, the toner image on the photosensitive drum 1 is electrostatically transferred onto the transferring material P. Following this, the transferring material P is separated from the photosensitive drum 1 and is transported to a not-shown fixing apparatus, which then performs a heat and pressure fixing process of the toner image.

The present invention is applicable also to an image forming apparatus in which a toner image is transferred from an image bearing member that is the photosensitive drum 1 directly onto a transferring material that is a transfer medium in this manner.

Meanwhile, the surface of the photosensitive drum 1 after the transfer is subjected to cleaning by a cleaning device 5 and a transfer residual toner, paper powder, and the like are removed from the photosensitive drum surface. Following this, residual electric charges are attenuated by a charge eliminating lamp 30, thereby making a preparation for the next image creation.

Next, how the transfer bias control is performed will be described. Like in the first embodiment, the transfer bias voltage value detection is performed under a state of charge ON before transfer during pre-rotation. Further, in this embodiment, the transferring material P exists between the photosensitive drum 1 and the transfer roller 19. Therefore, as has conventionally been known, a voltage Vp to be applied in the thickness direction of the transferring material P when a target current I0 is caused to flow to a white background portion needs to be added during transfer.

Therefore, in the transfer bias control in this embodiment, a white background (non-image portion) potential is formed during the pre-rotation and a voltage V0 is first obtained at which the target current I0 flows under the state of charge ON before transfer. Next, a transferring material voltage Vp obtained in advance is added and "V0+Vp" is set as a transfer bias for performing actual transfer onto a transferring material transported to the transfer part. Needless to say, like in the second embodiment, a correction of transfer roller resistance changing may be made by performing the control under the state of charge ON before transfer during the multiple rotation and performing it again under the state of charge OFF before transfer during the pre-rotation.

Fourth Embodiment

In each embodiment described above, a method has been described with which a transfer bias voltage value is optimally controlled in the case where the charge before transfer is performed. Such a technique of controlling a transfer bias voltage value in accordance with the change of the photosensitive drum surface potential is similarly applicable to an apparatus provided with a charge eliminating device for attenuating a photosensitive drum surface potential before transfer.

In an apparatus that uses a reversal developing system where development is performed by causing toner to adhere to each exposed portion of an electrostatic latent image, the potential of a transferring material charged to a polarity opposite to the charge polarity of a photosensitive drum and the potential of a white background portion (non-image portion) of the photosensitive drum greatly differ from each other after transfer, so that the transferring material is electrostatically adsorbed onto the photosensitive drum and it becomes difficult to separate the transferring material from the photosensitive drum. Therefore, the potential of the white background portion is attenuated to around zero prior to the transfer using an exposing lamp such as an LED, thereby facilitating the separation to be performed afterward. Note that in this specification, a toner image, for which charge elimination before transfer is performed, is referred to as the "pre-charge-elimination developed image".

Figure 7:
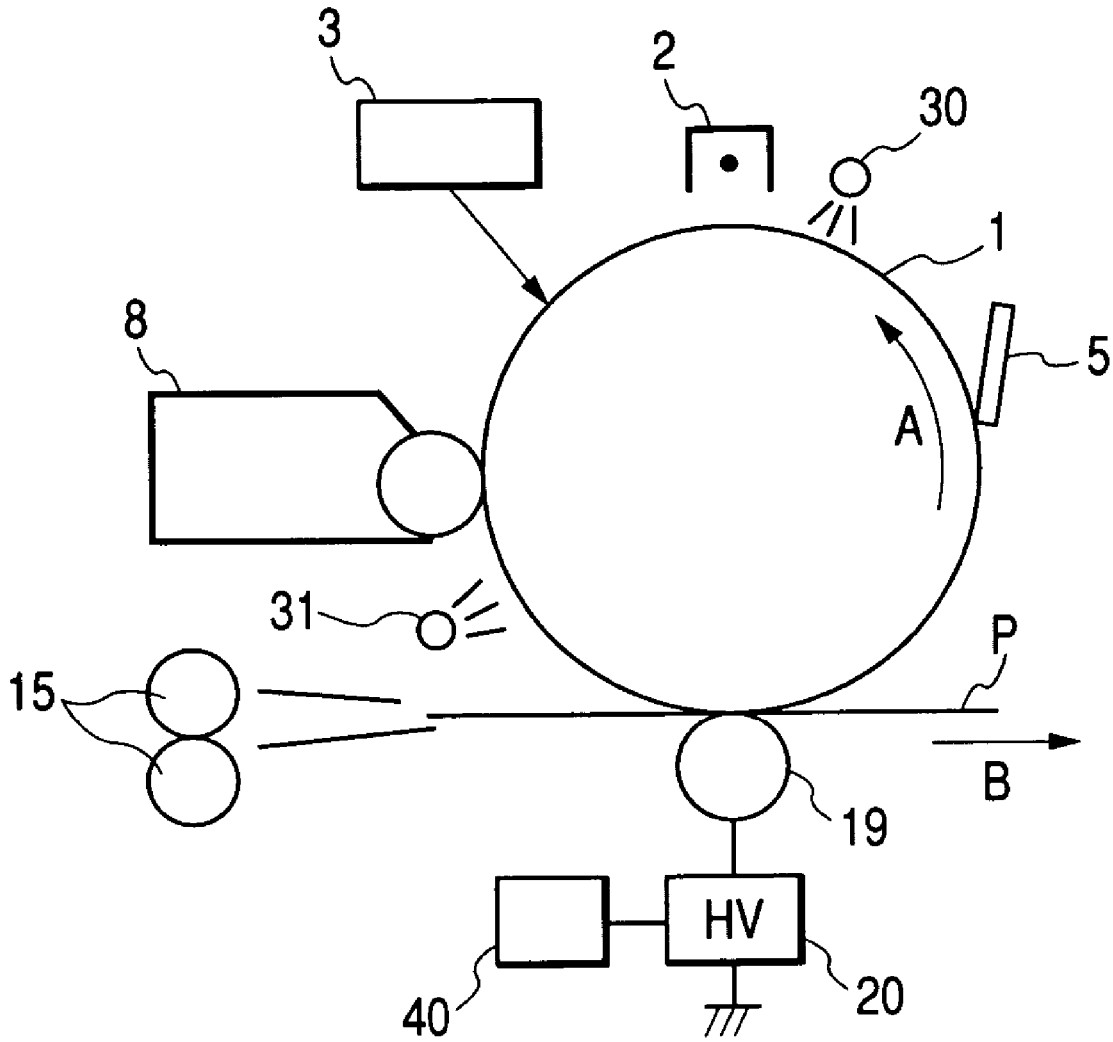
FIG. 7 is a schematic construction diagram showing a fourth embodiment of the image forming apparatus according to the present invention.

An example of this apparatus is shown in FIG. 7. The construction shown in FIG. 7 is approximately the same as that shown in FIG. 6 and the only difference therebetween is that an exposing lamp 31 serving as charge eliminating means before transfer is disposed in place of the charger before transfer 4 so as to face a photosensitive drum 1 on the downstream side of a developing device 8 in the rotation direction of the photosensitive drum 1.

Figure 8:
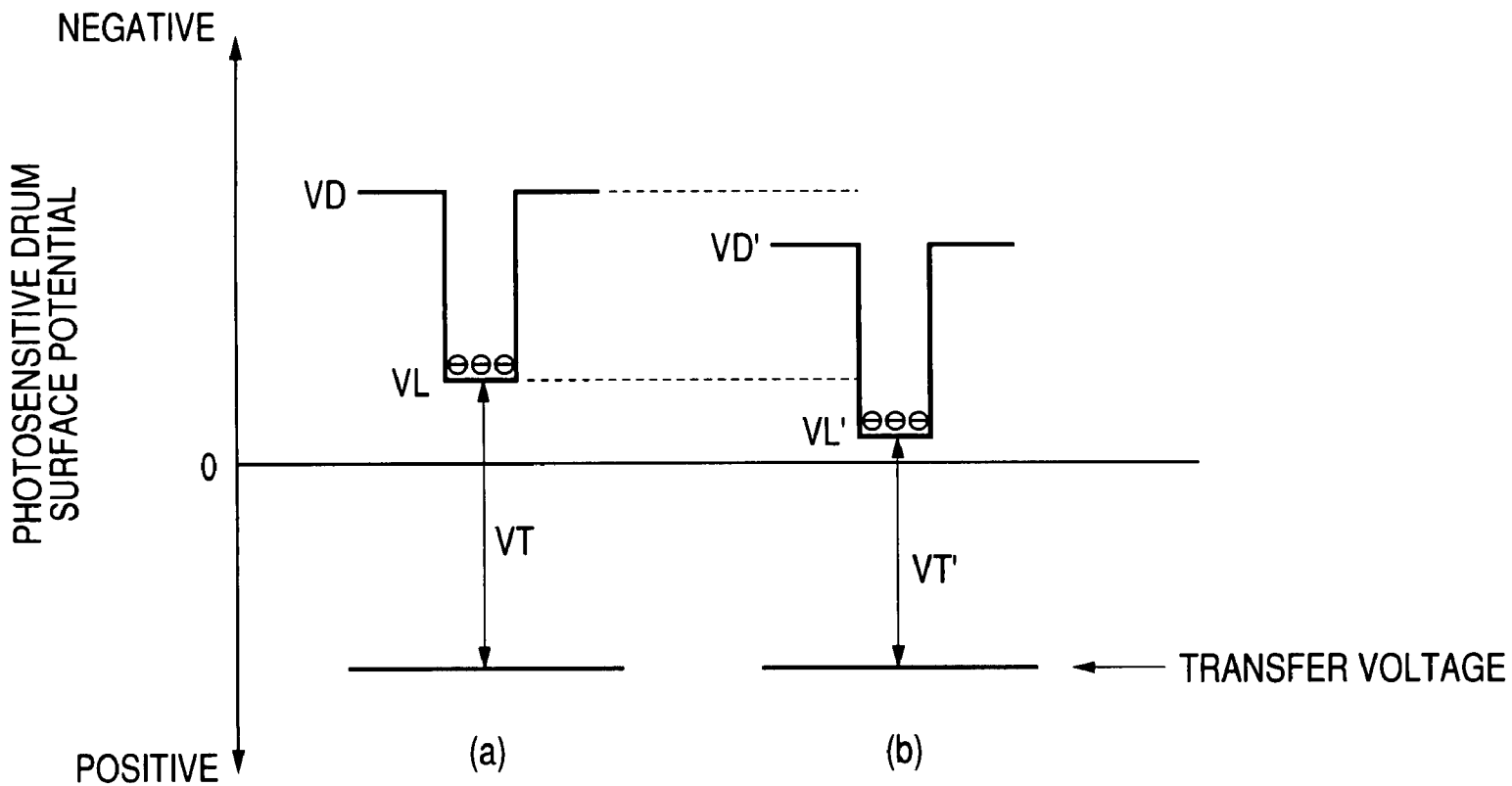
FIG. 8 is an explanatory diagram showing how the image bearing member surface potential changes and the relation thereof with the transfer bias in the fourth embodiment.

FIG. 8 shows how a potential changes due to the charge elimination before transfer by the exposing lamp 31. In FIG. 8, a potential before the charge elimination before transfer is shown on the left side (a) and a potential after the charge elimination before transfer is shown on the right side (b). On the left side (a), a potential VD of a portion subjected to charging and a potential VL of a portion subjected to exposure after the charging are shown. The photosensitive drum 1 in this embodiment is an OPC photosensitive drum having a negative charge property so that its potential has a negative polarity. Also, the reversal developing system is used in this embodiment, so that toner (having a negative polarity) moves to the VL portion and a toner image is developed.

Here, as a result of the charge elimination before transfer by the exposing lamp 31, VD and VL are respectively lowered to VD' and VL' shown on the right side (b).

Therefore, when a constant transfer bias having a positive polarity is applied, a potential difference VT (corresponding to a transfer electric field) between the potential VL of the toner image portion having the negative polarity and the transfer bias is reduced to VT' as a result of the charge elimination before transfer. Therefore, a current caused to flow is reduced and the transfer efficiency of the toner image is lowered. Consequently, density lowering occurs.

Figure 9:
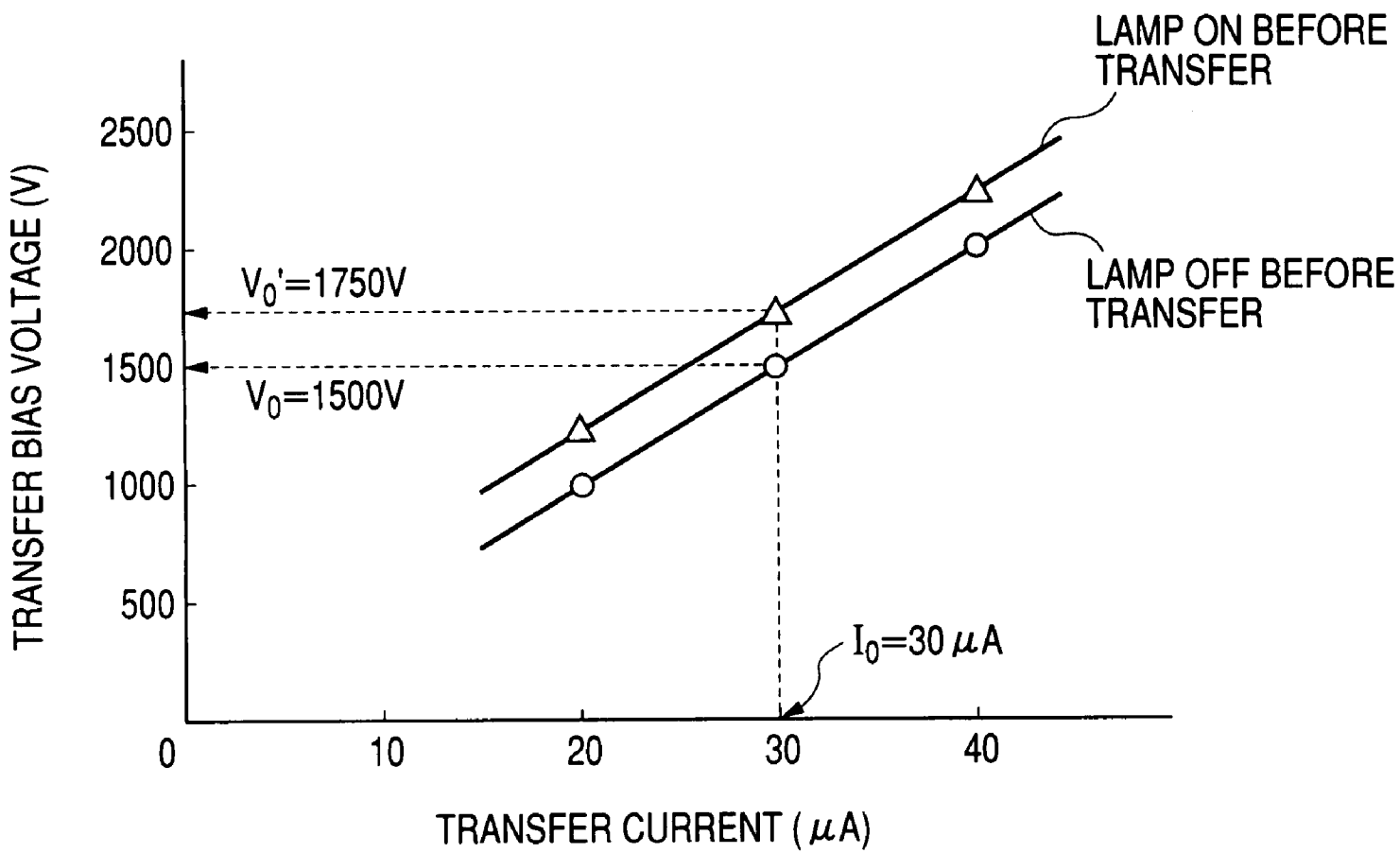
FIG. 9 is a graph showing the relation between the voltage and the current applied to the transfer means in the fourth embodiment.

A method of controlling a transfer bias in pre-processing process while giving consideration to the result described above is shown in FIG. 9. A control system that is the same as that in the first embodiment is used. During pre-rotation, a VD portion (corresponding to a white background (non-image portion) potential) is formed and transfer currents at 20 μA, 30 μA, and 40 μA are each applied to the transfer roller 19 as a constant current under this state and voltage values at that time are detected. In FIG. 9, a current-voltage relation in a case of charge elimination lamp OFF before transfer and a current-voltage relation in a case of charge elimination lamp ON before transfer at the same value as the quantity of light irradiated in an image creation process are both shown. In the lamp ON case, due to the reason described above, a voltage necessary to cause a predetermined current to flow increases. An optimum current for transferring a toner image that is a pre-charge developed image formed in the VL portion is obtained in advance through an experiment and a current I0 (=30 μA) flowing when a voltage applied at that time is applied to the VD portion (white background potential portion) is obtained. From the current-voltage relation detected in this manner, a transfer bias voltage value necessary to obtain I0 is calculated through liner interpolation.

Conventionally, the transfer bias voltage value detection is performed under a state of charge eliminating lamp OFF before transfer, so that the transfer bias is determined at V0 (=1500 V). However, image creation is performed under a state of charge eliminating lamp ON before transfer, so that if V0 is applied during the image creation, a current flowing to a white background portion becomes smaller than I0. In a like manner, a current flowing to a toner image portion is reduced and density lowering occurs.

In contrast to this, in this embodiment, the transfer bias voltage value detection is performed under a state of charge eliminating lamp ON before transfer, so that a deviation between a potential during the pre-rotation and a potential during the image creation is eliminated, which makes it possible to obtain an optimum transfer bias voltage value V0' (=1750 V). When V0' obtained in this manner is applied during the image creation, the current I0 flows to the white background portion and an optimum current flows to the toner image portion. As a result, the density lowering is prevented.

As described in the first to fourth embodiments, the charge before transfer or the charge elimination before transfer is performed at the time of the transfer bias control in the pre-processing process, so that the photosensitive potential in the pre-processing process and the photosensitive potential in the transfer process becomes equal to each other. By performing the transfer process using a transfer bias determined in the pre-processing process, a transfer current is set at an optimum value and re-transfer is prevented. In addition, the present invention is applicable to both of a color image forming apparatus and a monochrome image forming apparatus. Also, it does not matter whether the apparatus adopts the intermediate transfer system or a system where direct transfer from an image bearing member to a transferring material is performed.

It should be noted here that unless particular descriptions are specifically made, there is no intention to limit the scope of the present invention to the measurements, materials, shapes, relative positions, and other aspects of the component parts of the image forming apparatus described in the embodiments. Also, the present invention is applicable also to an apparatus adopting the electrostatic recording system by modifying the method of changing the image bearing member surface potential.

What is claimed is:

1. An image forming apparatus comprising:

toner image forming means for forming a toner image on an image bearing member;

charging means for charging the toner image on said image bearing member;

a transfer member for transferring the toner image charged by said charging means from said image bearing member to a transfer medium at a transfer portion;

detection means for detecting a relation between a voltage and a current on applying a monitor bias to the transfer medium, when a region of said image bearing member charged by said charging means is present in the transfer portion; and control means for variably controlling the transfer bias based on a detection result by said detection means.

2. An image forming apparatus according to claim 1, wherein said detection means detects the relation between the voltage and the current by applying a plurality of different monitor biases.

3. An image forming apparatus according to claim 2, wherein said transfer member is a roller, and said monitor bias is applied while said transfer member makes at least one rotation.

4. An image forming apparatus comprising:

a photosensitive member for bearing a toner image;

charging means for charging said photosensitive member;

electrosensitive latent image forming means for exposing said photosensitive member charged by said charging means to form an electrostatic latent image;

developing means for developing the electrostatic latent image to form the toner image;

charge eliminating means for exposing said photosensitive member bearing the toner image to eliminate a charge from said photosensitive member;

transfer member for transferring the toner image from said charge eliminated photosensitive member from which the charge has been eliminated to a transfer medium at a transfer portion by a transfer bias being applied;

detection means for detecting a relation between a voltage and a current on applying a monitor bias to said transfer medium, when a region of said image bearing member which is charged by said charging means and from which a charge is eliminated by said charge eliminating means is present in the transfer portion; and control means for controlling variably the transfer bias based on a detection result by said detection means.

5. An image forming apparatus according to claim 4, wherein said detection means performs detection by applying a plurality of different monitor biases.

6. An image forming apparatus according to claim 5, wherein said transfer member is a roller, and the monitor bias is applied while said transfer member makes at least one rotation.

* * * * *

UNITED STATES PATENT AND TRADEMARK OFFICE

CERTIFICATE OF CORRECTION

PATENT NO. : 7,106,984 B2
APPLICATION NO. : 10/823687
DATED : September 12, 2006
INVENTOR(S) : Katsumi It is certified that error appears in the above-identified patent and that said Letters Patent is hereby corrected as shown below:

ON THE TITLE PAGE:
Insert the following Item between Items (65) and (51)

--(30) Foreign Application Priority Data

Apr. 30, 2003 (JP) ..... 2003-125762--.

COLUMN 5:
Line 12, "the-image" should read --The image--.

Signed and Sealed this

Twenty-seventh Day of March, 2007

JON W. DUDAS
*Director of the United States Patent and Trademark Office*